US006005919A

United States Patent [19]

Kooy et al.

[11] Patent Number: 6,005,919

[45] Date of Patent: Dec. 21, 1999

[54] JAW AND CIRCULAR COLLIMATOR

[75] Inventors: Hanne M. Kooy, Newton; Fred L. Hacker, Brookline; Marc R. Bellerive, Boston, all of Mass.

[73] Assignee: Radionics, Inc., Burlington, Mass.

[21] Appl. No.: 08/736,792

[22] Filed: Oct. 25, 1996

[51] Int. Cl.[6] ..... G21K 1/02

[52] U.S. Cl. ..... 378/147; 378/65

[58] Field of Search ..... 378/65, 145, 148, 378/147, 150, 151, 152, 149

[56] References Cited

U.S. PATENT DOCUMENTS 4,489,426 12/1984 Grass et al. ..... 378/150

4,788,699 11/1988 Dobert et al. ..... 378/150

4,897,861 1/1990 Schaefer et al. ..... 378/150

5,166,531 11/1992 Huntzinger ..... 378/150 X 5,563,925 10/1996 Hernandez ..... 378/150

*Primary Examiner*—David P. Porta

*Attorney, Agent, or Firm*—Darby & Darby P.C.

[57] ABSTRACT

A collimator apparatus for a treatment planning machine that delivers a beam. A circular collimator defines a circular aperture for the beam. At least one movable collimator jaw is moved into the projection of the circular aperture with respect to the beam in order to eclipse a portion of the beam.

4 Claims, 1 Drawing Sheet

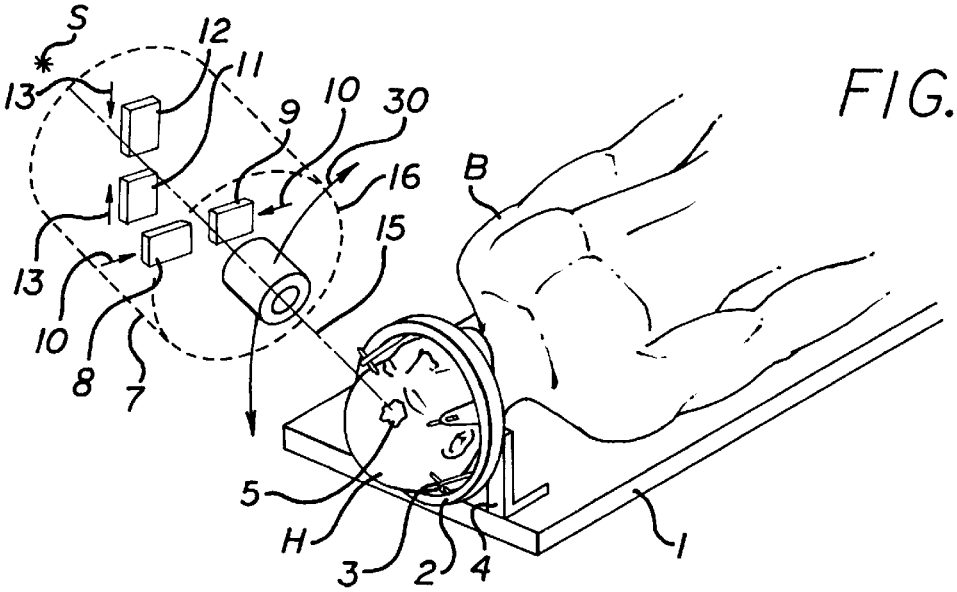
FIG. 1
FIG. 2
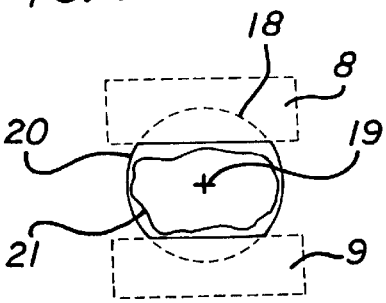
FIG. 3
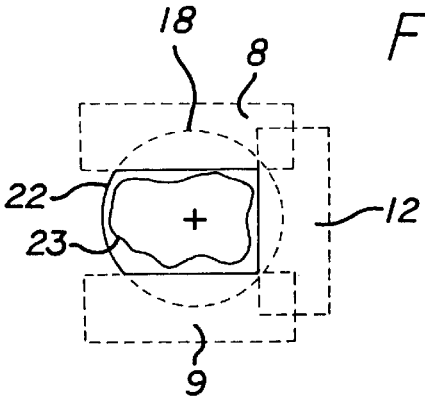
FIG. 4
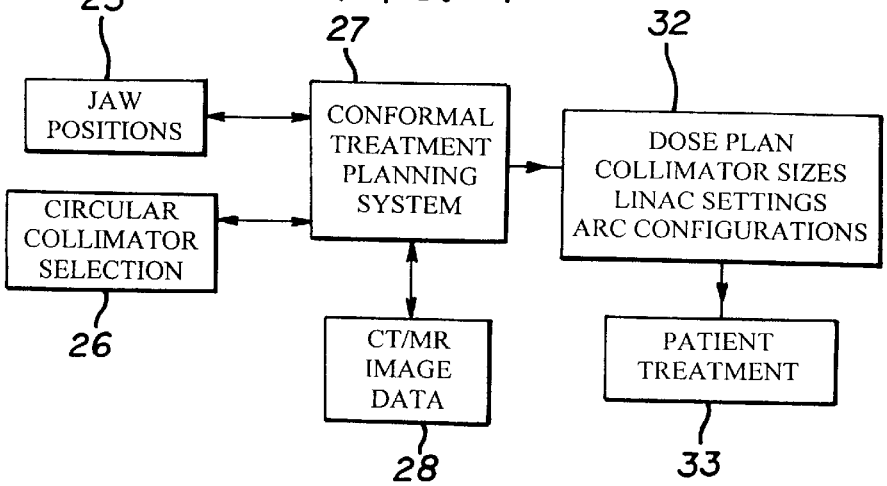

JAW AND CIRCULAR COLLIMATOR

BACKGROUND AND SUMMARY OF THE INVENTION

The use of heavy metal collimators of circular shape is now well known for sterotactic radiosurgery using treatment planning machines such as linear accelerators (LINACs) as an X-ray source (see the XKnife information from Radionics, Inc., Burlington, Mass.). Circular collimators made of lead or Cerrobend heavy metal with circular apertures of different sizes are used to collimate the X-ray beams from a LINAC. A collimator is rotated in a so-called gantry angle and couch angle around an isocenter at which position is located a target volume within the body of a patient. Conformal stereotactic radiosurgery involves use of irregularly shaped collimators that are typically non-circular. These may be so-called cut-block collimators, multi-leaf collimators, or miniature multi-leaf collimators (see the information from Radionics, Inc., Burlington, Mass. or Fischer GmbH, Frieburg, Germany). Conformal collimators are usually used in a static mode, meaning static discrete beam directions are determined and different collimators shapes are used depending on the shape of the target volume such as a tumor in the patient's head. Circular collimators are usually used in an arc mode, which means that the circular collimator is swept over the patient's head through the couch and gantry angles. A certain degree of target volume dose shaping is achieved by circular collimator arc therapy, but this is limited because of the limitation in shapes of the circular collimators. More conformal collimation is achieved by the cut-block or multi-leaf changeable shape collimators, but these are complicated devices and are labor intensive to make for a specific patient. In general, the system of the present invention is directed at an improved system for accomplishing conformal arc therapy for LINAC radiosurgery in the body. The system offers a simple and practical way of improving the dose distribution of X-rays for an irregularly shaped target volume by a combination of circular collimators and collimator blocking jaws which can be used to eclipse a portion of the circular beam aperture of the circular collimator.

Heavy metal blocking jaws are typically used in the heads of the linear accelerator to provide large field blocking for standard radiotherapy irradiation of X-rays. Typically, a set of two pairs of opposing jaws orthogonally oriented to each other and moveable in an orthogonal direction to the beam direction are present in the gantry head of a typical X-ray LINAC. These jaws alone are normally not adequate to perform stereotactic radiosurgery. The penumbra effects of use of the four jaws in a LINAC combined with arc therapy would not provide sufficient tightness of radiation for small to medium size brain tumors for instance to be effective for radiosurgery and are typically not employed for such application in radiosurgery. Use of the straight jaw and circular collimator configuration are disclosed herein together with treatment planning software to accommodate its use for conformal arc radiosurgery.

BRIEF DESCRIPTION OF THE DRAWINGS

In the drawings which constitute a part of the specification, exemplary embodiments exhibiting various objectives and features hereof are set forth, specifically:

FIG. 1 is a diagram of a system in accordance with the present invention.

FIG. 2 shows a beam's-eye view of jaws and circular collimators according to the present invention.

FIG. 3 shows a beam's-eye view of jaws and circular collimators as an alternate embodiment of the present invention.

FIG. 4 shows a process in accordance with the present invention.

DESCRIPTION OF THE INVENTION

The following embodiments illustrate and exemplify the present invention and concept thereof. Yet in that regard they are deemed to afford the best embodiments for the purpose of disclosure and to provide a basis for the claims herein which define the scope of the present invention.

Referring to FIG. 1, a patient's body B lies on a treatment machine couch 1 which is typical for a LINAC. The patient's head H is secured by a stereotactic ring 2 and head posts 3 to the patient's cranium. The ring 2 is immobilized to the LINAC couch by attachments 4. A target volume 5 is shown within the patient's head. A LINAC machine 7 is shown schematically by the dotted outline. Within the gantry of the LINAC are usually a set of blocking jaws which are typical opposing sets of orthogonal jaws, indicated by the pair 8 and 9 which move in the directions indicated by the arrow 10, and jaws 11 and 12, indicated by the arrows 13. A source of X-rays S delivers an X-ray beam with nominal direction indicated by the dashed line 15 converging on the target volume 5. The X-ray beam is defined by the outline of the circular collimator aperture 16 and the position of the jaws 8, 9, 11, and 12 as they intercept the beam profile through the aperture 16. The invention relates to the use, in combination, of circular apertures or other shaped fixed apertures together with blocking jaws in a linear accelerator to provide hybrid shapes of beams which enable better conformal dosimetry towards the target volume.

FIG. 2 gives an example of a so-called "beam's-eye view" of a circular collimator used in conjunction with straight edged jaws in accordance with the present invention. The circular collimator profile is indicated by the dashed outline 18, and the straight edged jaws are illustrated by the dashed area 8 and 9. This view is as seen by the beam looking down the direction of the circular collimator. The nominal beam axis of FIG. 1 is indicated through the point 19 in FIG. 2. The open area between the jaws 8 and 9 and the circular collimator is indicated by the solid line perimeter 20. For an irregularly shaped target volume, indicated by the profile 21, the solid line 20 conforms very much more closely to the target volume than if only the circular collimator 18 were used or, alternatively, if only the jaw configurations 8 and 9 were used. Thus the combination of the circular collimator and straight edged jaws gives much more conformality to a target volume from a given beam direction than the jaws separately or the circular collimators separately.

Referring again to FIG. 1, such a configuration of beam's-eye view profile would then be swept through arcs indicated by the arrows 30 according to the so-called gantry angle and couch angle of a linear accelerator (see the specifications, for example, from Varian Corporation, California, or Siemens Corporation, California, for LINACs).

Referring to FIG. 3 is another embodiment example of the present invention where (with similar numbering as given above) jaws 8 and 9 provide a straight edge perimeter and jaw 12 is one of an orthogonal pair which together with the circular collimator aperture gives rise to a solid line contour 22 that conforms relatively tightly to the tumor profile 23. Here the use of three jaws is invoked to eclipse the circular aperture 18 to provide better conformality. Other examples may be given of irregularly shaped tumors and one, two, three, or four jaws of the typical four pairs in a LINAC, as illustrated in FIG. 1, can be used to bring in secant type eclipses to the circular collimator shape to provide the best conformality with this combination of apertures. Different size radius collimators 18 could be invoked, depending on the size of the tumor.

In accordance with the present invention and illustrated by FIG. 4, a system and process comprising determination of jaw positions 25 and selection of circular collimators 26 is used in cooperation with a conformal treatment planning system 27 such as the XKnife software and computer workstation of Radionics, Inc., Burlington, Mass. Such a computer workstation will have input data from image scanning of the patient's body 28 from a CT or MRI scanner, and treatment planning of beams and dosimetry can be handled in computer system 27. From this, a selection of jaw configurations in combination with circular aperture sizes can be derived, thus determining the values of jaw position 25 and circular collimator size 26. Once determined for a given arc, the jaws and circles may be fixed and the delivery of an arc with this configuration, such as illustrated by arc 30 in FIG. 1, can give rise to conformal radiation to target volume 5. The jaws may also move as the beam arc is swept over the patient in a more dynamic mode. Thus, a process of treatment planning with jaw and circular arc beams is illustrated. CT image data 28 together with treatment planning system is in accordance with the target volume and appropriate beam positions. Thereby, a selection of jaw positions and circular collimator sizes can be determined together with associated arc therapy. The treatment planning system 27 can also derive the arc positions and the arc lengths as well as X-ray dose to optimize the dosimetry on a target such as 5 in FIG. 1. Dose algorithms can be derived (such as those from XKnife or XPlan of Radionics, Inc., Burlington, Mass.) that can derive dosimetry from such jaw/circular collimator ports with swept LINAC arcs. The results of such dosimetry indicate, according to the present invention, that the quality of the conformality of the dose to the target volume is superior and the degree of radiation to normal tissue outside of the target volume is reduced from the situation where only circular collimators are used or only standard jaw configurations are used independently. Thus the present invention represents an improvement over the dosimetry possible by each of these previously used, independent methods. Since square jaws are existent in most standard linear accelerators, and circular collimators are used in standard radiosurgery, the combination of these two elements when used according to the present invention can give substantially superior radiation dose to a target volume. Once a treatment plan has been derived, the appropriate dose plan, collimator sizes, LINAC settings, and arc configurations can be derived (element 32), and the treatment of the patient can proceed (element 33).

Variations of the present invention may be apparent to those skilled in the art, and the system may take other forms with a multitude of variations. The use of non-circular collimators (aperture 16) can be invoked, and this can be used as cut blocks. The use of non-orthogonal jaws in a LINAC may also be used. A non-conventional set of jaws involving one or more jaw configurations may be used in conjugation with a circular aperture in accordance with the present invention to improve treatment planning. For instance, a special set of extra jaws could be built into the LINAC in conjugation with a circular collimator as a dedicated jaw-circle collimator apparatus. Various dose algorithms may be used to determine the dosimetry for jaws and circular collimators. In view of these considerations, and as will be appreciated by persons skilled in the art, implementations, systems, and processes could be considered broadly and with reference to the claims as set for below.

We claim:

1. A collimator system for a treatment planning machine which delivers a beam comprising:

a. a circular collimator which defines a circular aperture for said beam, said circular aperture being positionally fixed with respect to said beam; and, b. at least one collimator jaw that can be moved into the projection of said circular aperture with respect to said beam so as to eclipse a portion of said beam before it enters said circular aperture;

whereby the combined beam aperture of said circular collimator and said collimator jaw deviates from a circular aperture by the degree that said collimator jaw intersects said projection of said circular aperture with respect to said beam.

2. The collimator system of claim 1 wherein said treatment planning machine is a source of an X-ray beam.

3. The collimator system of claim 1 wherein said at least one collimator jaw comprises one of the standard blocking jaws of a linear accelerator.

4. The collimator system of claim 1 and further comprising a treatment planning computer with software which can plan dosimetry from said collimator system based on the circular aperture, position of said at least one collimator jaw, and orientation of said beam through said collimator system in the direction of said beam when said beam is irradiating a patient.

* * * * *